US009797244B2

(12) United States Patent
Gostkowski et al.

(10) Patent No.: US 9,797,244 B2
(45) Date of Patent: Oct. 24, 2017

(54) APPARATUS AND METHOD FOR OBTAINING FORMATION FLUID SAMPLES UTILIZING A FLOW CONTROL DEVICE IN A SAMPLE TANK

(71) Applicants: Kyle A. Gostkowski, Houston, TX (US); James T. Cernosek, Missouri City, TX (US)

(72) Inventors: Kyle A. Gostkowski, Houston, TX (US); James T. Cernosek, Missouri City, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 470 days.

(21) Appl. No.: 14/100,638

(22) Filed: Dec. 9, 2013

(65) Prior Publication Data

US 2015/0159483 A1 Jun. 11, 2015

(51) Int. Cl.
*E21B 49/00* (2006.01)
*E21B 49/10* (2006.01)

(52) U.S. Cl.
CPC ..... *E21B 49/10* (2013.01)

(58) Field of Classification Search
CPC ..... F16K 1/02; F16K 1/12; F16K 1/44; F16K 1/443; F16K 11/044; E21B 49/081; E21B 49/10
See application file for complete search history.

(56) References Cited

U.S. PATENT DOCUMENTS 820,556 A * 5/1906 Cooke ..... B67D 3/0045 137/625.27
916,403 A * 3/1909 Adamson ..... F16K 11/044 137/549
997,681 A * 7/1911 Lenderoth ..... F16K 1/443 137/614.21
1,171,610 A * 2/1916 Hauer ..... F16K 1/443 137/460

(Continued)

FOREIGN PATENT DOCUMENTS

EP 1282794 B1 11/2012

OTHER PUBLICATIONS

All-metal valves, Section 2.5, MDC Vacuum Limited, http://www.caburn.co.uk/resources/downloads/pdfs/sec2.5.1.pdf, 1 sheet.

(Continued)

*Primary Examiner* — Robert E Fuller
*Assistant Examiner* — Steven MacDonald
(74) *Attorney, Agent, or Firm* — Cantor Colburn LLP

(57) ABSTRACT

In one aspect, an apparatus for use in a wellbore formed in a formation is disclosed that in one embodiment includes a probe for obtaining a formation fluid into a flow line, a pump for extracting formation fluid from a formation into the flow line, a chamber for receiving the formation fluid from the probe, and a flow control device that controls the formation fluid flow from the flow line into a chamber, wherein the flow control device includes a movable member that moves between a first seal position and a second seal position, wherein the flow control device is closed when the movable (Continued)

member is in the first seal position and the second seal position and is open when the movable member is between the first seal position and the second seal position.

19 Claims, 3 Drawing Sheets

(56) References Cited

U.S. PATENT DOCUMENTS

| | | | | |
|---|---|---|---|---|
| 2,805,685 | A * | 9/1957 | Jopson | F16K 1/443 138/42 |
| 3,038,487 | A * | 6/1962 | Gardner | F16K 11/044 137/112 |
| 3,138,175 | A | 6/1964 | Chilcoat | |
| 3,379,407 | A | 4/1968 | Napolitano | |
| 3,572,629 | A * | 3/1971 | Clark | F16K 47/04 251/121 |
| 3,954,138 | A * | 5/1976 | Miffre | E21B 34/063 137/68.16 |
| 4,153,187 | A * | 5/1979 | Marrington | G01F 11/32 222/440 |
| 4,487,222 | A | 12/1984 | Crawford | |
| 4,729,545 | A | 3/1988 | Belhustede | |
| 5,156,181 | A | 10/1992 | Maalouf et al. | |
| 5,419,530 | A | 5/1995 | Kumar | |
| 5,421,358 | A | 6/1995 | Jaeger | |
| 6,244,566 | B1 | 6/2001 | France et al. | |
| 7,213,613 | B2 | 5/2007 | Spakowski et al. | |
| 7,303,011 | B2 | 12/2007 | Reid et al. | |
| 7,418,998 | B2 * | 9/2008 | Aoki | G01M 3/228 165/104.33 |
| 8,360,095 | B2 | 1/2013 | Morgan et al. | |
| 2005/0155760 | A1 | 7/2005 | Hill et al. | |
| 2005/0230118 | A1 | 10/2005 | Noske et al. | |
| 2006/0243033 | A1 * | 11/2006 | Freemark | E21B 49/10 73/64.45 |
| 2008/0135299 | A1 | 6/2008 | Fields et al. | |
| 2010/0038573 | A1 * | 2/2010 | Lucas | F16K 1/303 251/149.6 |

OTHER PUBLICATIONS

PCT International Search Report and Written Opinion; International Application No. PCT/US2014/068815; International Filing Date: Dec. 5, 2014; dated Mar. 25, 2015; pp. 1-20.

* cited by examiner

APPARATUS AND METHOD FOR OBTAINING FORMATION FLUID SAMPLES UTILIZING A FLOW CONTROL DEVICE IN A SAMPLE TANK

BACKGROUND OF THE DISCLOSURE

1. Field of the Disclosure

The present disclosure relates generally to apparatus and methods for formation fluid collection and testing.

2. Description of the Related Art

During both drilling of a wellbore and after drilling, fluid (oil, gas and water) from the formation ("formation fluid") is often extracted to determine the nature of the hydrocarbons in hydrocarbon-bearing formations using a formation testing tool that contains one or more chambers or tanks for collecting fluid samples. The fluid samples are tested downhole during collection process and at the surface to determine various properties of the extracted formation fluid. During drilling of a well, a drilling fluid is circulated through a drill string and the annulus between the drill string and the wellbore diameter. The pressure of the drilling fluid on the formation is greater than the pressure of the formation in which the well is drilled. The drilling fluid invades into the formation surrounding the wellbore to varying depths, referred to as the invaded zone, which contaminates the original or connate fluid present in the invaded zone. To collect samples of the original fluid present in the formation, either during drilling or post drilling, a formation testing tool is conveyed into the wellbore. A probe having a fluid line is sealingly pressed against the wellbore wall. A pump typically extracts the fluid from the formation into the probe. The initially extracted fluid is discarded into the wellbore while testing it for contamination. When the extracted fluid is sufficiently clean, fluid samples are collected in one or more chambers (tanks) for analysis. Single and multiple probes have been utilized for extracting formation fluid.

Each sample chamber is typically placed in a tank carrier in the body of the formation testing tool. The chamber is connected to a flow line for receiving fluid inside the chamber. A manual valve is placed inside the chamber while a hydraulically-operated valve is placed outside the chamber in the tank carrier for controlling the flow of the formation fluid into the chamber. The manual valve is set in the open position at the surface, while the hydraulically-operated valve is in the closed position. To collect a sample in the chamber, the pump is operated to withdraw the formation fluid and the hydraulically-operated valve is opened to allow the fluid to enter into the chamber. Upon retrieval of the chamber to the surface, the manual valve is closed to ensure no fluid leakage from the chamber, the hydraulically-operated valve disconnected and then the chamber is removed from the tank carrier. The manual valve is made of metal and includes a single seal point, which is prone to a common problem known as jetting which is caused by a combination of a high pressure differential across the seal and small flow areas across the seal. Jetting causes abrasive materials in the formation fluid to deteriorate the quality of the seal, which in turn may cause leakage. Any leakage from a sample chamber can negatively affect the quality of the collected sample. The manual valve's sensitivity to jetting makes it necessary to leave the valve open while down hole in addition to including the hydraulically-operated valve to control the flow of the formation fluid into the sample chamber.

The disclosure herein provides a formation evaluation system that utilizes a dual-seal valve that addresses some of the above-noted issues and may also be utilized inside a sample chamber, replacing the manual valve and eliminating the need of the hydraulically-operated valve.

SUMMARY

In one aspect, an apparatus for use in a wellbore formed in a formation is disclosed that in one embodiment includes a probe for obtaining a formation fluid into a flow line, a pump for extracting formation fluid from a formation into the flow line, a chamber for receiving the formation fluid from the probe, and a flow control device that controls the formation fluid flow from the flow line into a chamber, wherein the flow control device includes a movable member that moves between a first seal position and a second seal position, wherein the flow control device is closed when the movable member is in the first seal position and the second seal position and is open when the movable member is between the first seal position and the second seal position.

In another aspect, a method of collecting a formation fluid sample is disclosed that in one non-limiting embodiment may include: conveying a formation testing tool in a wellbore that includes a probe for obtaining a formation fluid into a flow line, a pump for extracting formation fluid from a formation into the flow line, a chamber for receiving the formation fluid from the probe, and a flow control device that controls the formation fluid flow from the flow line into a chamber, wherein the flow control device includes a movable member that moves between a first seal position and a second seal position, wherein the flow control device is closed when the movable member is in the first seal position and the second seal position and is open when the movable member is between the first seal position and the second seal position; positioning the formation testing tool at a selected location in the wellbore; positioning the movable member of the flow control device to one of the first seal position and the second seal position; placing the probe against the wellbore; extracting the formation fluid into the flow line by the pump, moving the movable member of the flow control device from one of the first seal position and the second seal position to a position between the first seal position and the second seal position to allow the formation fluid to enter into the chamber; collecting the formation fluid in the chamber; moving the movable member to the other of the first seal position and the second seal position to close the flow control device; and retrieving the formation testing tool to the surface.

Examples of certain features of the apparatus and methods disclosed herein are summarized rather broadly in order that the detailed description thereof that follows may be better understood. There are, of course, additional features of the apparatus and methods disclosed hereinafter that will form the subject of the claims.

BRIEF DESCRIPTION OF THE DRAWINGS

For detailed understanding of the present disclosure, references should be made to the following detailed description, taken in conjunction with the accompanying drawings, wherein.

DESCRIPTION

Figure 1:
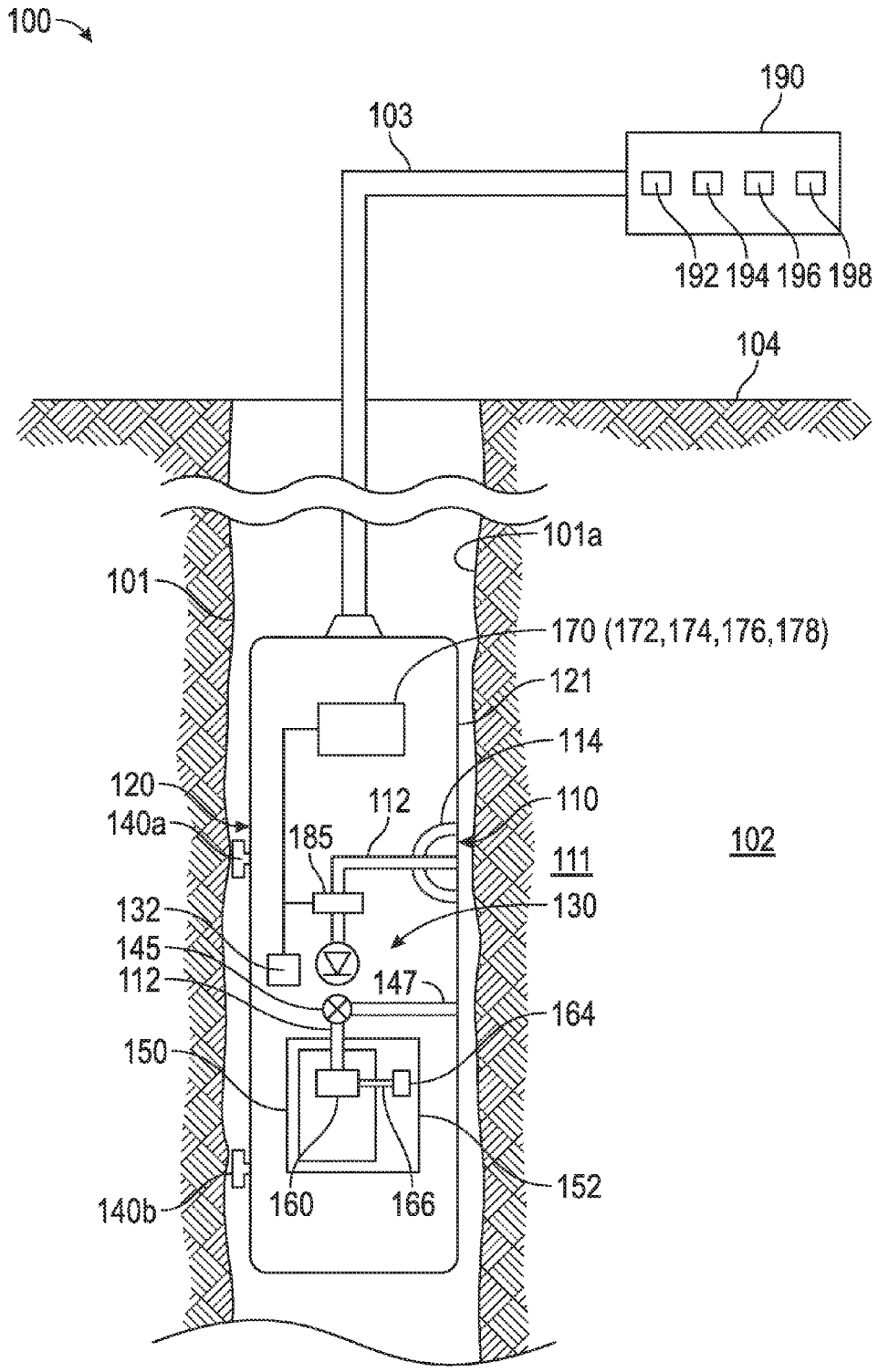
FIG. 1 is a schematic diagram of an exemplary formation testing system for obtaining formation fluid samples, according to one embodiment of the disclosure.

FIG. 1 is a schematic diagram of an exemplary formation evaluation system 100 for obtaining formation fluid samples and retrieving such samples to the surface for determining one or more properties of such fluid. The system 100 is shown to include a downhole formation evaluation tool 120 deployed in a wellbore 101 formed in a formation 102. The tool 120 is shown conveyed by a conveying member 103, such as a wireline, coiled tubing or a drilling tubular, from a surface location 104. In one embodiment, the tool 120 includes a probe (a fluid extraction or fluid withdrawal device) 110 that may include a fluid conduit or flow line 112 and a pad or packer 114 around the flow line 112. The probe 110 may be extended from a tool body 121 radially outward against the wellbore wall 101*a*, as known in the art. Pads 140*a* and 140*b* on the opposite side of the probe 110 are extended so that the probe 110, when extended, will urge and seal against the wellbore wall 101*a*.

A pump 130 is coupled to the fluid line 112 for withdrawing the formation fluid 111 into the flow line 112. The pump may be driven by a motor 132, such as a hydraulic motor. In one aspect, the flow line 112 from the pump is connected to an inlet of a sample chamber or tank 150, which is carried by or placed in chamber or tank carrier 152. In one non-limiting embodiment, a flow control device, such as valve 160, is connected to the flow line 112 and placed inside the chamber 150. In another aspect, the valve 160 may be operated by an electric motor 164 placed outside the chamber 150 via a shaft member 166. Another flow control device, such as a valve 145, is provided in the flow line 112 between the pump 130 and the valve 160 to enable the formation fluid 111 to flow to the chamber 150 via flow line 112 or to the wellbore via a flow line 147. One or more suitable sensors, collectively labeled 185, include but are not limited to, an optical sensor and a density sensor may be utilized to determine contamination in the fluid 111 in line 112. In one aspect, the valve 160 is closed when the tool 120 is deployed downhole. The tool 120 further includes a controller 170 for controlling certain operations of the tool 120, such as closing and opening valves, operating the pump and processing signals from the sensors 168. In one aspect, the controller 170 may include circuits 172 for preprocessing signals from sensors 168 and operating various components of the tool 120, a processor 174, such as a microprocessor for processing signals and data, a data storage device 176, such as a solid state memory, and programs 178 accessible to the processor 174 for executing instruction contained therein. The system 100 also may include a controller 190 at the surface that contains circuits 192, a processor 194, a data storage device 196 and programs 198 accessible to processor 194 for executing instructions contained therein. Controllers 170 and 190 are in a two-way communication with each other via wireline 103 and either controller alone or in combination may control the operation of the various devices in tool 120.

To obtain a sample of the clean formation fluid, tool 120 is conveyed and placed at a selected depth in the wellbore 101. Pads 140*a* and 140*b* are activated to contact the wellbore wall 101*a*. The probe 110 is activated to urge and seal against the wellbore wall 101*a*. Pump 130 is activated to draw the formation fluid 111 into flow line 112. The fluid initially drawn through the probe 110 is representative of the fluid present in the invaded zone and is thus contaminated. The fluid evaluation or testing device 185 determines when the fluid 111 being withdrawn from probe 110 is sufficiently clean so that fluid samples may be collected. As long as the contamination in the fluid 111 being withdrawn from the invaded zone is above a threshold or is otherwise not satisfactory, such fluid may be discharged into the wellbore 101 via a flow control device 145 and fluid line 147. Once the fluid 111 is clean (i.e., below a threshold), the valve 160 is opened and valve 145 is closed. The fluid is then collected in sample chamber 150. Once the sample has been collected, valve 160 is closed. The pump 130, valves 145 and 160 and any other device in the tool 120 may be controlled by the controller 170 according to instructions stored in programs 178 and/or instructions provided by the surface controller 190. Alternatively, controller 190 may control the operation of one or more such devices in the tool 120 according to instructions provided by programs 198. Once the sample has been collected, the tool 120 is retrieved to the surface and chamber 150 is detached from the carrier. Because the valve 160 is inside the chamber 150 and is in the closed position, the chamber 150 may simply be detached or removed from the carrier 160 without need to close an external manual or another valve. Certain non-limiting embodiments of a valve suitable for use in the system 100 are described in reference to FIGS. 2 and 3.

Figure 2:
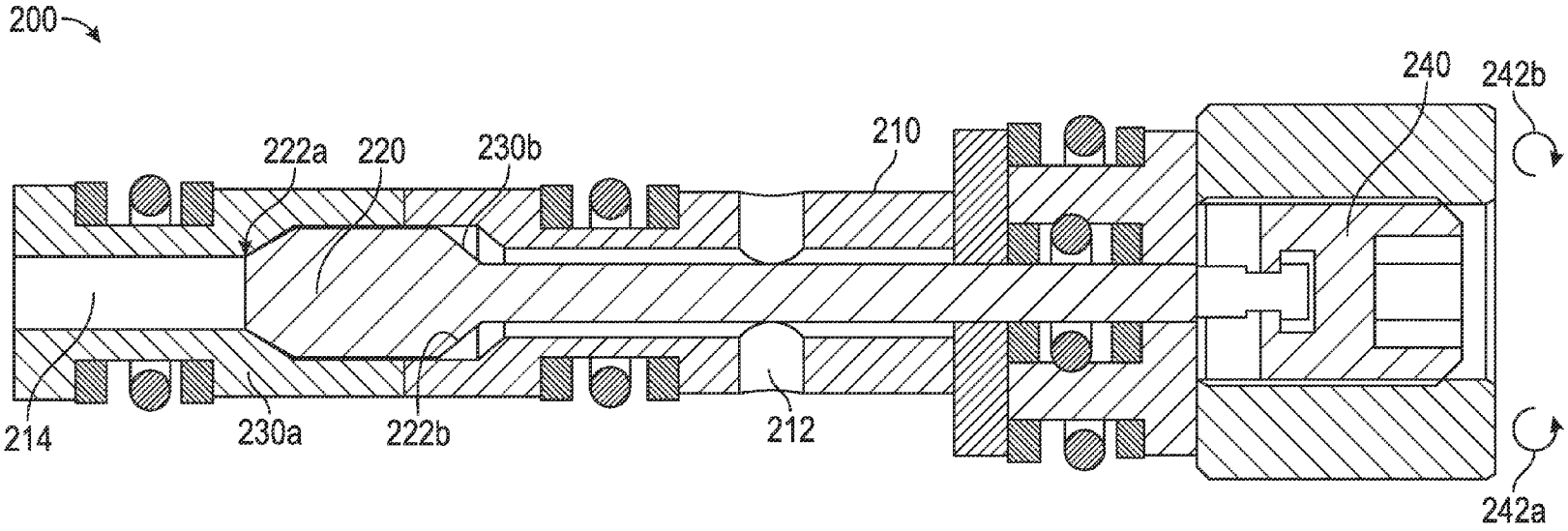
FIG. 2 is a line diagram of a non-limiting embodiment of a dual-seal flow control device for use in the system of FIG. 1.

FIG. 2 is a cross-sectional view of a non-limiting embodiment of an electrically-operated dual-seal valve 200 that may be utilized as the flow control device 160 for collecting a formation sample in a formation testing system, such as system 100 shown in FIG. 1. Referring now to FIGS. 1 and 2, valve 200 includes a valve body 210 that includes an inlet port 212 for connection to the probe 110 via flow line 112. An outlet 214 associated with valve 200 discharges fluid from the valve 200 to inside the chamber 150. In one non-limiting aspect, the valve 200 may include a seal member that causes the valve to close (in a closed position) when the seal member is in either a first position or a second position and causes the valve to open (in an open position) when the seal member is in a position between the first position and the second position. In the particular embodiment of the valve 200, the seal member shown is a poppet 220 that moves between a first seal point or seat 230*a* and a second seal point or seat 230*b*. The valve 200 is closed when the poppet 220 is against either the seal seat 230*a* or 230*b* and is open when the poppet 220 is between the seal seats 230*a* and 230*b*. The poppet 220 may be moved in either direction by any suitable mechanism. In the particular embodiment of FIG. 2, poppet 220 is connected to a hex nut 240 via a member 250, such as a rod. The hex nut 240 may be rotated in both the clockwise direction 242*b* and anti-clockwise direction 242*a* by an electric motor, such as motor 164 shown in FIG. 1. When the hex nut 240 is rotated in a first direction, for example clockwise direction 242*b*, the poppet 220 moves toward seal seat 230*a* and when the hex nut is rotated in the second direction (anti-clockwise) 242*a*, the poppet 220 moves toward seal seat 230*b*. In one aspect, the end 222*a* of the poppet 220 may be a chamfered end and the seal seat 232*a* may be correspondingly chamfered to mate with the poppet end 222*a* so that when the end 222*a* mates with seal seat 230*a*, they form a seal, which in one aspect may be a metal-to-metal seal. Any other suitable sealing surfaces may also be utilized for the purpose of this disclosure. Similarly, end 222*b* and seal seat 230*b* may be made to provide a seal when such surfaces mate. In one aspect, the valve 200 is placed in a closed position by moving the poppet 220 to mate with the seal seat 232*a* before the tool 120 is deployed into the wellbore 101. To collect the sample, the poppet 220 is moved between the seal seats 230*a* and 230*b* to allow the formation fluid 111 to flow from the inlet 212 to the chamber 111 via outlet 214. Once the sample has been collected in the chamber 150, the poppet is moved to cause the end 222*b* to urge against the seal seat 230*b* to close the valve 200. When the tool 120 is brought to the surface, the chamber 150 is removed from the chamber carrier 152 and the collected sample analyzed.

Figure 3:
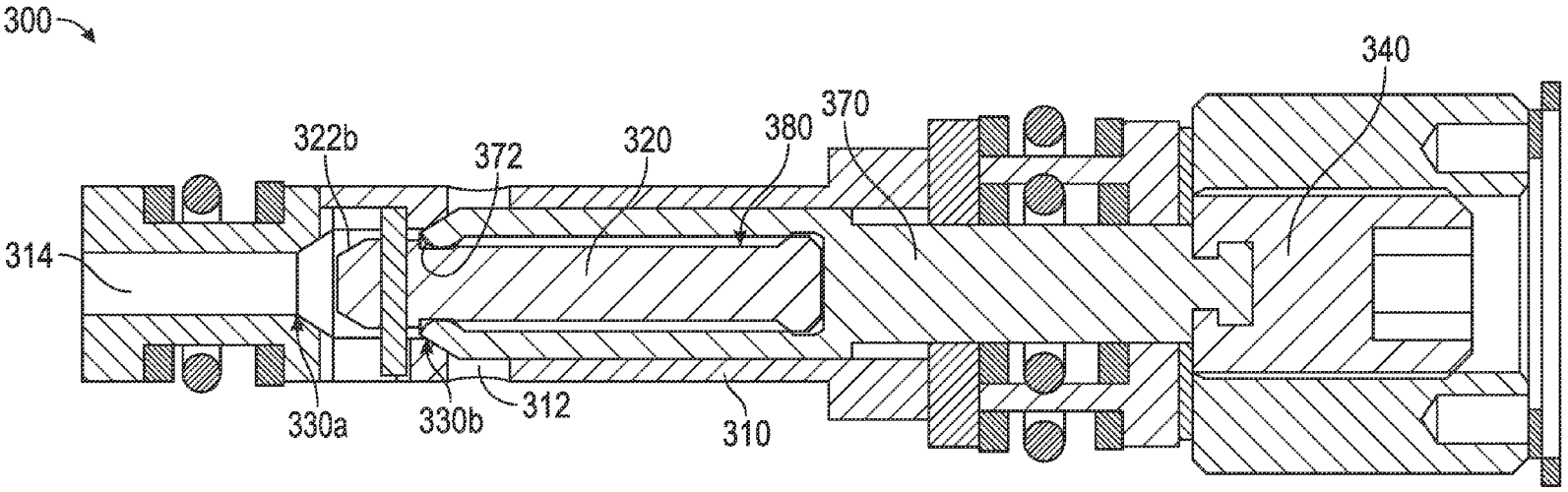
FIG. 3 is a line diagram of another non-limiting embodiment of a dual-seal flow control device for use in the system of FIG. 1.

FIG. 3 is a cross-sectional view of another non-limiting embodiment of a dual-seal valve 300 that may be utilized as the flow control device 160 in the system 100 of FIG. 1. Referring now to FIGS. 1 and 3, the valve 300 may be placed inside the tank 150 to receive formation fluid from the flow line 112. In one non-limiting embodiment, valve 300 includes a valve body 310 that includes an inlet port 312 for connection to the probe 110 via flow line 112. An outlet 314 associated with valve 300 discharges the formation fluid 111 from the valve 300 to inside the chamber 150. In one non-limiting aspect, the valve 300 includes a first movable seal member that causes the valve to close when the first seal member is against a first seal seat or and a second movable seal member that causes the valve to close when the second movable seal member is against a second seal seat. The valve 300 is open when the first movable seal member is away from the first seal seat and the second movable seal member is away from the second seal seat. In the particular embodiment of the valve 300, the first movable seal member is shown to include a first poppet 320 having a seal end 322 that moves toward and away from the first seal point or seat 330*a*. The valve 300 is closed when the poppet 320 is against the seal seat 330*a*. The valve 300 further includes a second poppet 370 connected to the first poppet 320, which is further connected to a hex nut 340, which may be rotated by an electric motor, such as motor 164. The second poppet 370 includes a seal end 372 that moves toward and away from a second seal seat 330*b*. The valve 300 is closed when the seal end 372 is against seal seat 330*b*. The valve is open when seal end 322 is away from the seal seat 330*a* and the seal end 372 is away from the seal seat 332*b*. When the hex nut 340 is rotated in a first direction, for example clockwise, the second poppet 370 moves in one direction, for example to the right, which moves the first poppet 320 to the left, i.e., toward the first seal seat 330*a*. Similarly, when the hex nut 340 is rotated anticlockwise, the second poppet 370 moves to the left, causing the first poppet 320 to move to the right. In one aspect, poppets 320 and 370 may be connected to each other via opposing threads 380 so that when poppet 370 moves in one direction, poppet 320 moves in the opposite direction. The valve 300 is shown in a closed position as the seal end 372 is against the seal seat 330*b*. To collect a formation fluid sample, the hex nut 340 is rotated so as to cause the poppet 320 to move toward seal seat 330*a* and poppet 370 to move away from seal seat 330*b* to allow the formation fluid 111 to flow from the inlet 312 to outlet 314 and then into the chamber 150. After collecting the formation fluid sample, poppets 320 and 370 are moved until the seal end 322 is against the seal seat 330*a* or seal end 372 is against the seal seat 330*b*, depending on the initial valve state, thereby closing the valve 300. The seal end 322 of the poppet 320 and seal seat 330*a* may be chamfered to mate with each other to provide a metal-to-metal seal. Similarly the seal end 372 of the poppet 370 and the seal seat 330*b* may be chamfered to mate with each other to provide a metal-to-metal seal. The valve 300 may be placed inside the chamber 150 and operated by a motor placed outside the chamber 150, such as motor 164 in system 100.

Referring to FIGS. 2 and 3, poppets 220 in FIG. 2 creates seals at both of its ends, while poppet 320 creates a seal at one of its ends and poppet 370 creates seal at one of its ends. The outer dimensions of such poppets are shown in a "small-large-small" configuration in that the ends are of smaller diameter than the diameter of the middle. Alternatively, such poppets may be configured to operate in the same manner as described above in reference to poppets 220, 320 and 370 but configured as "large-small-large", where the ends are of larger diameter than the middle. In another aspect, the seals on the poppets and seal seats may be replaceable.

In aspects, the dual-seal valves 200 and 300 reduce or eliminate a common problem known as "jetting" wherein the combination of high pressure differentials and small flow areas causes abrasive materials in the formation fluid 111 to degrade the quality of the seals. In the case of formation sample tanks, any leakage from a deteriorated seal can negatively affect the quality of the sample collected. In the embodiments of valves 200 and 300, poppets with chamfered seal ends and their corresponding mating seal seats to form metal-to-metal seals, which aid in reducing or eliminating the jetting effect.

While the foregoing disclosure is directed to the embodiments of the disclosure, various modifications will be apparent to those skilled in the art. It is intended that all variations within the scope and spirit of the appended claims be embraced by the foregoing disclosure.

The invention claimed is:

1. An apparatus for use in a wellbore formed in a formation, comprising:

a chamber conveyable into the wellbore for receiving a formation fluid;

a flow line for flow of the formation fluid from the formation into the chamber;

a flow control device including an inlet and an outlet, wherein the flow control device controls the flow of the formation fluid from the flow line into the chamber, wherein the flow control device includes a movable member adapted to move a seal member in an expanded region of the flow line between a first seal seat and a second seal seat, the seal member including a first end and a second end opposite the first end, wherein the seal member prevents flow from the inlet to the outlet when either the first end of the seal member is mated to the first seal seat or the second end of the seal member is mated to the second seal seat and allows flow between the inlet and the outlet when the seal member is between the first seal seat and the second seal seat such that the first end is not mated to the first seal seat and the second end is not mated to the second seal seat; and a rotatable member that causes the movable member to move in a first direction when the rotatable member rotates in a clockwise direction and causes the movable member to move in a second direction when the rotatable member rotates in an anticlockwise direction.

2. The apparatus of claim 1, wherein at least one of the first seal end, second seal end, first seal seat and the second seal seat is replaceable.

3. The apparatus of claim 1, wherein each of the first seal position and the second seal position comprises a metal-metal seal.

4. The apparatus of claim 1, wherein the flow control device is placed inside the chamber.

5. The apparatus of claim 1 further comprising a motor outside the chamber that rotates the rotatable member.

6. The apparatus of claim 1, wherein the movable member includes a first movable member having the first seal end and a second movable member having the second seal end, wherein the first seal position occurs when the first seal end mates with the first seal seat and the second seal position occurs when the second seal end mates with the second seal seat.

7. The apparatus of claim 1 further comprising:

a probe for obtaining a formation fluid into the flow line, wherein the probe is extendable against a wall of the wellbore; and a pump for extracting the formation fluid from the formation into the flow line.

8. The apparatus of claim 1, wherein the first seal end and the second seal end of the seal member each is chamfered to respectively mate with the first seal seat and the second seal seat.

9. A method of collecting a formation fluid sample, comprising:

conveying a tool in a wellbore that includes a flow control device that controls the formation fluid flow from a flow line into a chamber, wherein the flow control device includes an inlet, an outlet and a movable member, wherein the moveable member moves between a first seal position and a second seal position, wherein the flow control device prevents flow from the inlet to the outlet when the movable member is in the first seal position, the flow control device prevents flow out of the flow control device when the movable member is in the second seal position and allows flow between the inlet and the outlet when the movable member is between the first seal position and the second seal position;

positioning the formation testing tool at a selected location in the wellbore;

positioning the movable member of the flow control device to one of the first seal position and the second seal position;

extracting the formation fluid into the flow line;

moving the movable member of the flow control device from one of the first seal position and the second seal position to a position between the first seal position and the second seal position to allow the formation fluid to enter into the chamber; and collecting the formation fluid in the chamber;

moving the movable member to the other of the first seal position and the second seal position to close the flow control device.

10. The method of claim 9 further comprising placing the flow control device inside the chamber prior to conveying the formation testing tool into the wellbore.

11. The method of claim 10 further comprising;

determining contamination in the formation fluid in the flow line; and moving the movable member between the first seal position and the second seal position after the determined contamination meets a selected threshold.

12. The method of claim 11 further comprising a motor that rotates the rotatable member.

13. The method of claim 10, wherein the movable member includes a first movable member having the first seal end and a second movable member having the second seal end and wherein the first seal position occurs when the first movable member mates with the first seal seat and the second seal position occurs when the second movable member mates with the second seal seat.

14. The method of claim 13, wherein when the first movable member moves, the second movable member moves in a direction opposite to the first movable member.

15. The method of claim 9, wherein the flow control device includes a first seal seat and a second seal seat and wherein the movable member includes a first seal end and a second seal end and wherein the first seal position occurs when the first seal end of the mates with first seal seat and the second seal position occurs when the second seal end mates with the second seal seat.

16. The method of claim 15, wherein at least one of the first seal end, second seal end, first seal seat and second seal seat is replaceable.

17. The method of claim 9, wherein each of the first seal position and the second seal position comprises a metal-metal seal.

18. The method of claim 9, wherein the flow control device further includes a rotatable member that causes the movable member to move in a first direction when the rotatable member rotates in a clockwise direction and causes the movable member to move in a second direction when the rotatable member rotates in a clockwise direction.

19. The method of claim 9, wherein the flow control device is placed inside the chamber.

* * * * *